US005581923A

United States Patent [19]

Brandstetter

[11] Patent Number: 5,581,923

[45] Date of Patent: Dec. 10, 1996

[54] POINT OF PURCHASE DISPLAY WITH ATTACHED RISER CARD

[76] Inventor: Edward Brandstetter, 300 E. 40th St., New York, N.Y. 10016

[21] Appl. No.: 323,362

[22] Filed: Oct. 14, 1994

[51] Int. Cl.[6] ..... G09F 15/00

[52] U.S. Cl. ..... 40/606; 40/610; 248/447; 248/459; 248/460

[58] Field of Search ..... 40/539, 610, 606, 40/642; 248/459, 460, 447, 174; 211/49.1, 195

[56] References Cited

U.S. PATENT DOCUMENTS

| | | | |
|---|---|---|---|
| 1,247,871 | 11/1917 | Page | 40/539 X |
| 1,818,799 | 8/1931 | Haas | 40/539 |
| 1,886,036 | 11/1932 | Marx | 40/539 |
| 2,055,201 | 9/1936 | Leigh . | |
| 2,135,124 | 11/1938 | Englar | 40/539 |
| 2,144,594 | 1/1939 | Katz . | |
| 2,332,642 | 10/1943 | Johnson . | |
| 2,362,230 | 11/1944 | Ziemmerman . | |
| 2,613,643 | 10/1952 | Transue | 40/610 |
| 2,731,748 | 1/1956 | Polay . | |
| 2,762,148 | 9/1956 | Alcaraz | 40/610 X |
| 2,773,324 | 12/1956 | Drueck, Jr. . | |
| 2,851,804 | 9/1958 | Roach . | |
| 3,004,744 | 10/1961 | Wall | 248/174 |
| 4,279,375 | 7/1981 | Gardner | 248/174 X |
| 4,492,580 | 1/1985 | Sabel | 40/539 X |
| 4,607,817 | 8/1986 | Aquino | 248/460 X |
| 4,690,272 | 9/1987 | Adams . | |
| 4,813,536 | 3/1989 | Willis | 248/174 X |
| 4,947,985 | 8/1990 | Crabtree et al. . | |
| 5,003,912 | 4/1991 | Thurston | 40/610 X |

FOREIGN PATENT DOCUMENTS

| | | | |
|---|---|---|---|
| 1302552 | 7/1962 | France | 40/642 |

*Primary Examiner*—Joanne Silbermann
*Attorney, Agent, or Firm*—Brooks Haidt Haffner & Delahunty

[57] ABSTRACT

A point of purchase display that has a horizontal base formed of thermoplastic material and an upright riser can be stored and shipped in a compact state and set up without the use of tools at the location where the display is used. The riser is formed from a flat sheet of cardboard with score lines for folding. The score lines can permit the riser to be attached to the base and folded under the base for storage and shipping and then allow the riser to be pivoted to an upright position where the riser is held in place. Various embodiments of the three-dimensional display are described and illustrated.

18 Claims, 6 Drawing Sheets

FIG. 1
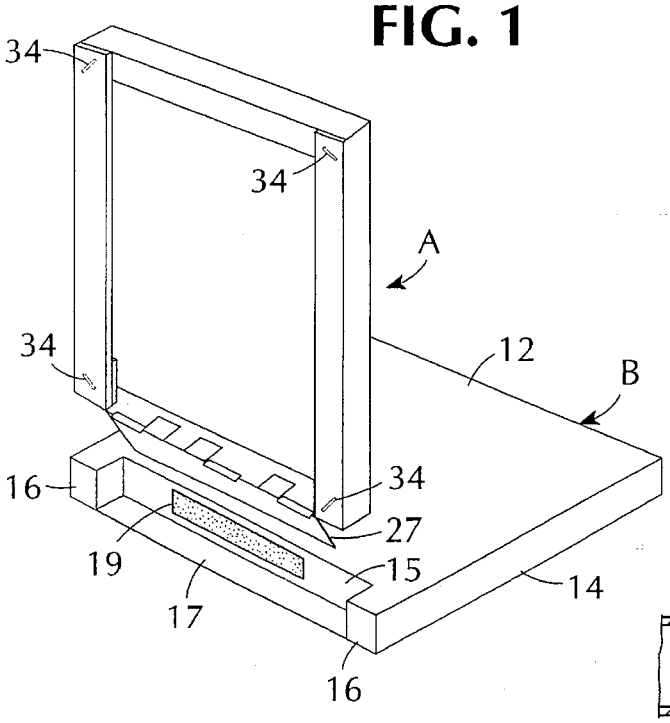
FIG. 4
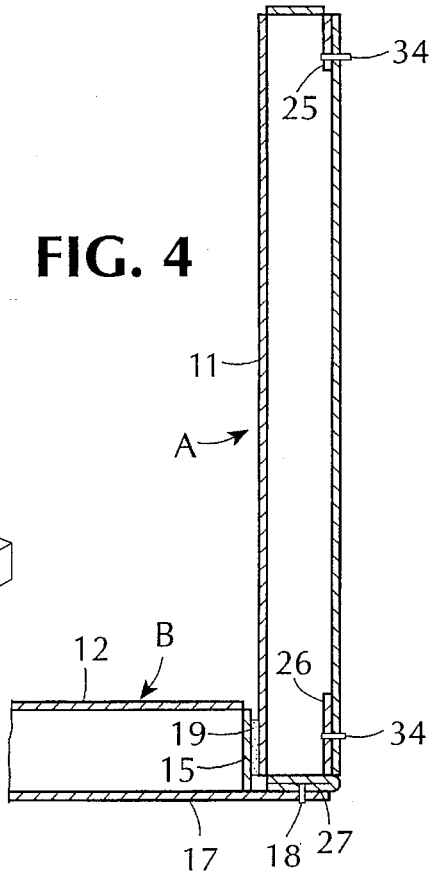
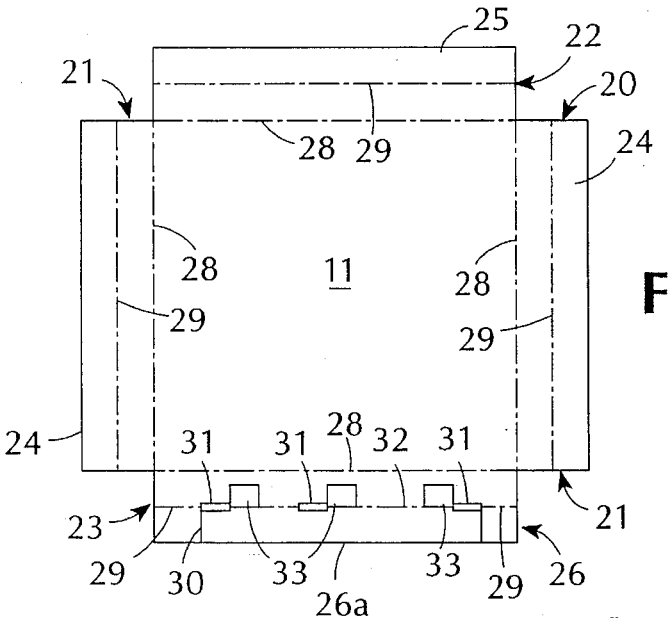
FIG. 2
FIG. 5
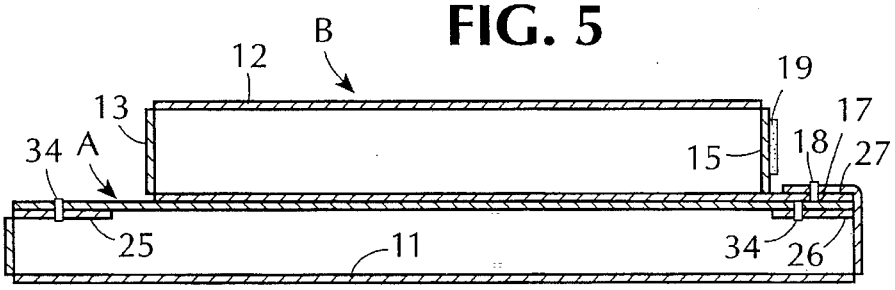

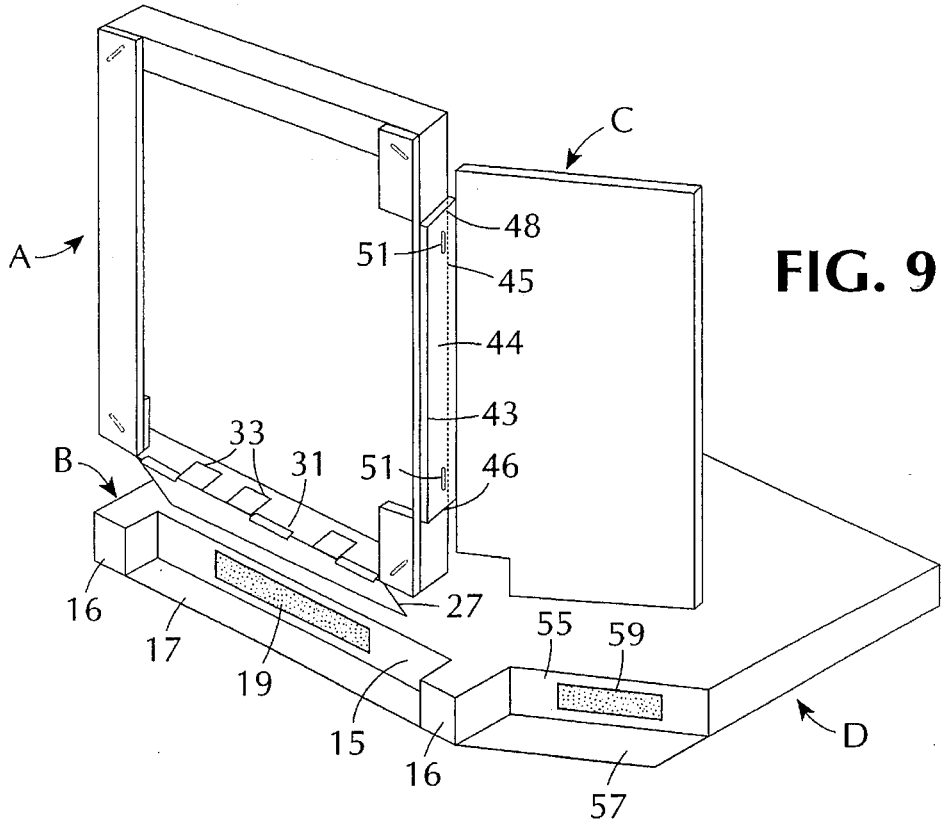
FIG. 9
FIG. 10
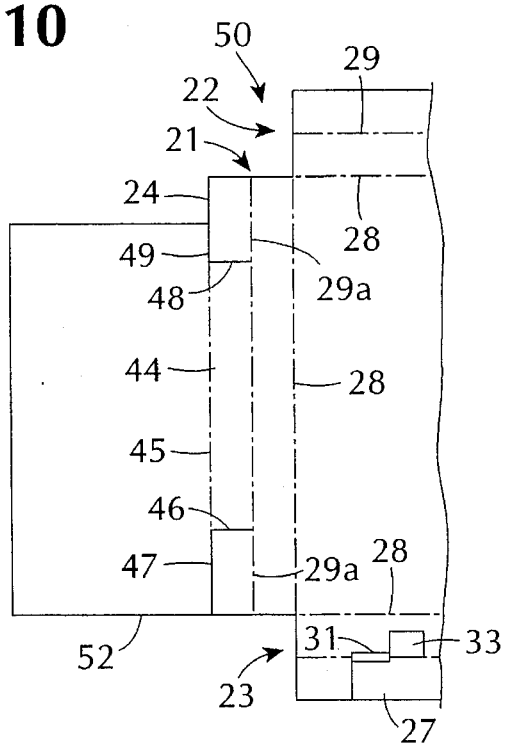

FIG. 17
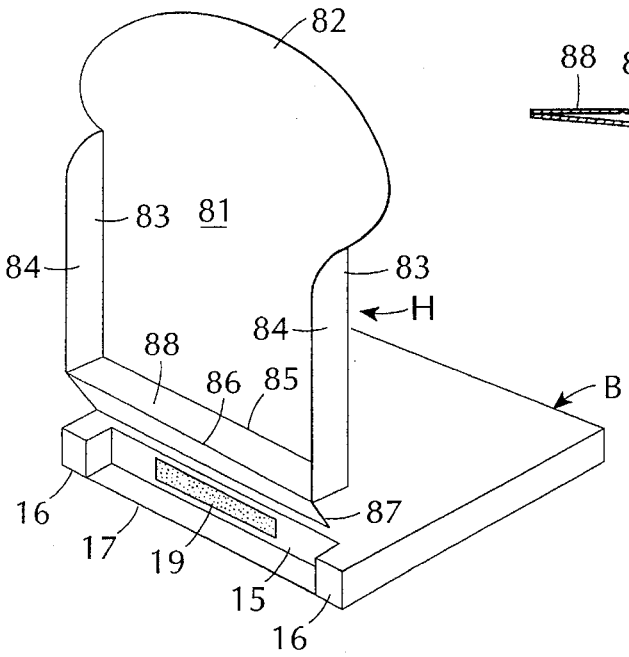
FIG. 18
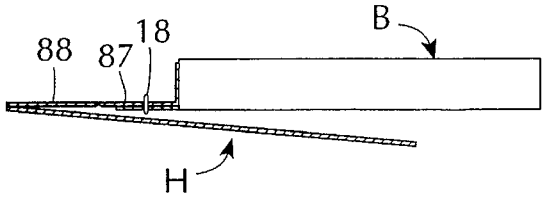
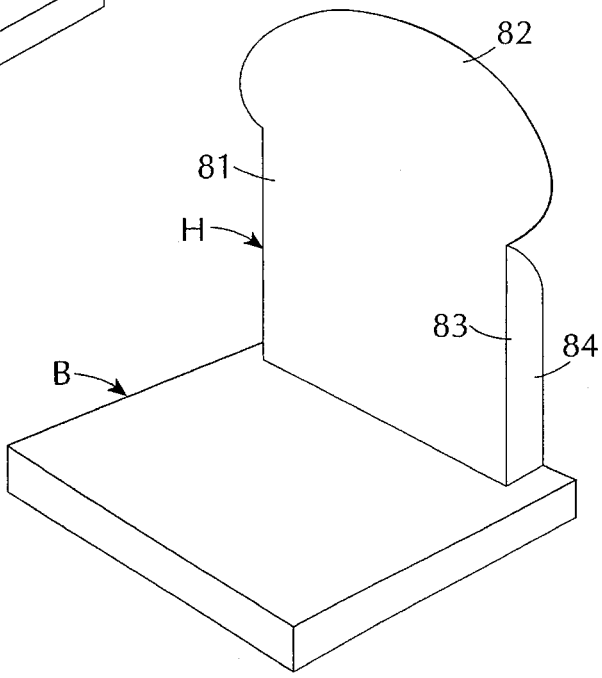
FIG. 20
FIG. 19
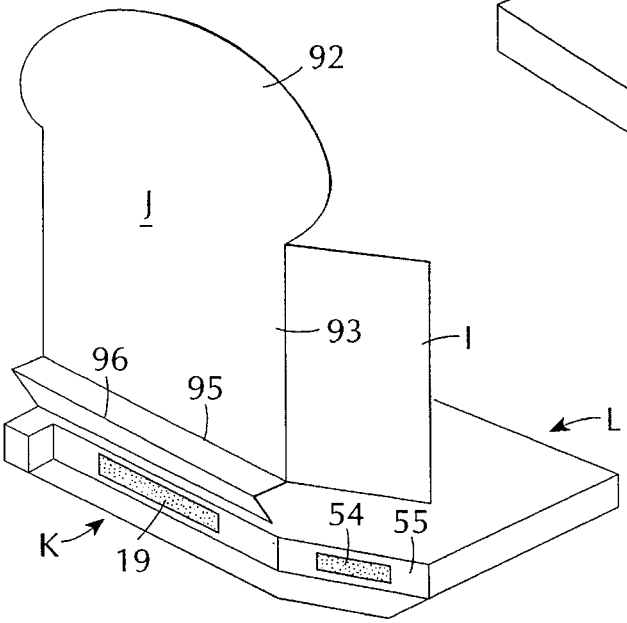

POINT OF PURCHASE DISPLAY WITH ATTACHED RISER CARD

BACKGROUND OF THE INVENTION

1. Field of the Invention

The invention relates to point of purchase displays for consumer products, and more particularly to displays of the kind that have a horizontal base on which the actual product is displayed and an upstanding panel showing a pictorial illustration or advertising, promotional or descriptive information about the product.

2. Description of the Prior Art

Point of purchase displays are an effective means for promoting the sale of consumer products and are widely used in shops and markets. In department stores, self-service retail stores and in shops such as drugstores where customer assistance is provided, point of purchase displays show the consumer that the desired product or product line is available for purchase and also inform the prospective purchaser about new products or special offers. Free standing displays are commonly placed atop the sales counters where the promoted products are for sale. Showing the actual merchandise in close conjunction with advertising or promotional information invites the consumer to take a good look at the displayed product, and in some cases, to pick up the product for closer examination.

The point of purchase display may be as simple as the colorful picture on the inside of the lid of the old-fashioned cigar box that moves a smoker to buy a particular brand of cigar. Examples of other displays that also serve as containers for products are found in U.S. Pat. Nos. 4,690,272 to Adams and 4,947,985 to Crabtree et al.

Because of the nature of the product or other considerations, it is often impractical for the display itself to serve as the shipping package or service dispenser for the goods. For example, it may be desirable to package large quantities of each of several varieties, such as different colors, sizes or flavors of a product, in separate shipping containers and then to display one or more of each of the several different varieties of the product together in a single tray or on a common platform.

Of course, a plain flat card, sign or picture can be placed on a stand near articles displayed on a counter, but such advertising devices can be accidentally knocked over or displaced from their intended positions, and in any case flat displays are not ordinarily as effective in attracting a consumer's attention as three-dimensional displays holding examples of the product itself. Three-dimensional display devices of various kinds are shown, for example, in Leigh U.S. Pat. No. 2,055,201; Katz 2,144,594; Ziemmerman 2,362,230; and Polay 2,731,748.

Prior art arrangements consisting of flat elements for assembly into a three-dimensional display have been difficult for sales personnel to set up properly. Erecting a three-dimensional display from prefabricated flat display elements shipped flat may pose difficulties, but it is impractical to ship fully set up three-dimensional displays because of considerable volume they occupy when shipped in set-up condition and the relatively low structural strength of the displays.

SUMMARY OF THE INVENTION

The present invention provides a three-dimensional display for consumer products that can be shipped in a compact configuration and easily set up on-site by unskilled personnel without the use of tools. When erected, the display is stable, sturdy and durable.

The display of the invention consists essentially of two parts, a base and a riser, which are shipped to and received as a unit by the user, to be quickly and easily set up at the location where the display is to be used. For purposes of handling, shipping and storage, the display in its unextended configuration is a compact, flat package. The base and riser can be hingedly interconnected parts.

The base can suitably be formed of styrene or some other thermoplastic material by known injection molding or vacuum forming techniques, which make it possible to produce a relatively sturdy yet light-weight unit, to which the riser can be secured. The riser is preferably of stiff cardboard, such as 50 point cardboard, which can have a suitable finish, with a picture or text or both printed on one or both surfaces.

When the riser is hingedly connected to the base, as in a preferred embodiment of the invention, the riser is formed with a fold line that allows the hinging movement. The cardboard stock employed must be able to take crease scores along fold lines so that the cardboard can be folded back upon itself at a fold line through an angle up to 360 degrees without cracking or breaking at the fold line. The formation of a crease score breaks fibers in the cardboard material, which permits folding along the score line, but if the board stock is much thicker than 50 point (0.050), cracking or breaking can result from folding. Cardboard stock thinner than about 45 or 50 point thickness may be insufficiently rigid for the intended use. In one embodiment of the invention the riser has two mutually parallel score lines aligned with an edge of the riser.

An elongated rectangular flap portion of the riser lies between the edge of the riser and the body or main part of the riser, with a crease score formed between the flap and the riser body. This flap is secured to an elongated rectangular flange portion of the base lying along a rear of the base, preferably by a plurality of staples passing through the flap and the body flange. The body or main portion of the riser can be rotated about this crease score in either direction with respect to the base and the flap secured to the base, so that the body of the riser can stand up perpendicular to the base or lie flat underneath the base.

When the riser body is in its upright position, perpendicular to the base, the riser can be held firmly in place by means of a strip of adhesive tape affixed to a vertical rear wall portion of the base that extends upward from the inner edge of the base flange. In other words, the base has a step at its rear provided by the rear wall portion that lies between the generally horizontal upper surface of the base and the base flange at the rear of the base, which step receives the lower part of the riser when the riser body is set upright.

The base can have a pair of rearwardly extending legs at opposite ends of the rear flange portion, so that when the riser is in upright condition the sides of the riser fit between the legs of the base, providing added support and stability to the riser. Although the riser body can be a simple flat card, in its preferred form the riser is preferably in the form of a three-dimensional frame, with a flat face from which top, bottom and side panels extend back at an angle with respect to the riser face. Lower portions of the riser side panels will then lie against inner vertical side walls of the rearwardly extending legs of the base when the riser is in upright condition.

One basic embodiment of the invention presents a photograph or other graphic display of a convenient and attractive size, say 15 inches high by 12 wide (38×30 cm) on the flat vertical face of the riser. The riser surmounts the three-dimensional base that extends forward beneath the picture, and the product promoted by the picture is displayed atop the base, which can have recesses formed in its upper face to hold some of the items for sale, such as, for example, packages of cosmetics. The base may have recesses formed in its upper surface to hold individual items that prospective purchasers can pick up for closer consideration. The entire three-dimensional assembly, although inexpensive to produce, easily set up and light in weight, gives a sense of solidity and value that would not be imparted by a plain, flat poster or sign that seems temporary and cheap.

The riser and base need not be rectangular in plan. For example, the riser can have a wing arranged at an angle to the principal front face of the riser, with an extension of the base underlying the wing. Side panels surrounding the riser face can lie at right angles to the plane of the riser face, or can be arranged at an oblique angle with respect to the face.

Other objects and advantages of the point of purchase display with attached riser card will be more fully understood when the following detailed description of preferred embodiments is read with attention to the accompanying drawing figures, in which like reference characters designate like parts throughout.

BRIEF DESCRIPTION OF THE DRAWINGS

FIG. 1 is a view in perspective of the point of purchase display of the invention, with the riser not attached to the base to illustrate cooperating parts.

FIG. 2 is a plan view of the blank from which the riser of the display of FIG. 1 is formed.

FIG. 4 is a partial side view in section of an assembled display according to FIG. 1 with the riser in its upright position.

FIG. 5 is a side view in section of an assembled display according to FIG. 1 with the riser folded under the base in condition for storage or shipping.

FIG. 9 is a view similar to that of FIG. 7 showing a modified form of display according to the invention.

FIG. 10 is a partial plan view of the blank from which the riser of the display of FIG. 9 is formed.

FIG. 17 is a perspective view similar to that of FIG. 1, showing a modified form of the display of the invention with the riser unconnected to the base.

FIG. 18 is a side view in section of the display shown in FIG. 17, in collapsed form, with the riser folded under the base.

FIG. 19 illustrates another modified embodiment of the display according to the invention.

FIG. 20 is a perspective view of another embodiment of the display of the invention.

DETAILED DESCRIPTION OF PREFERRED EMBODIMENTS

Figure 6:
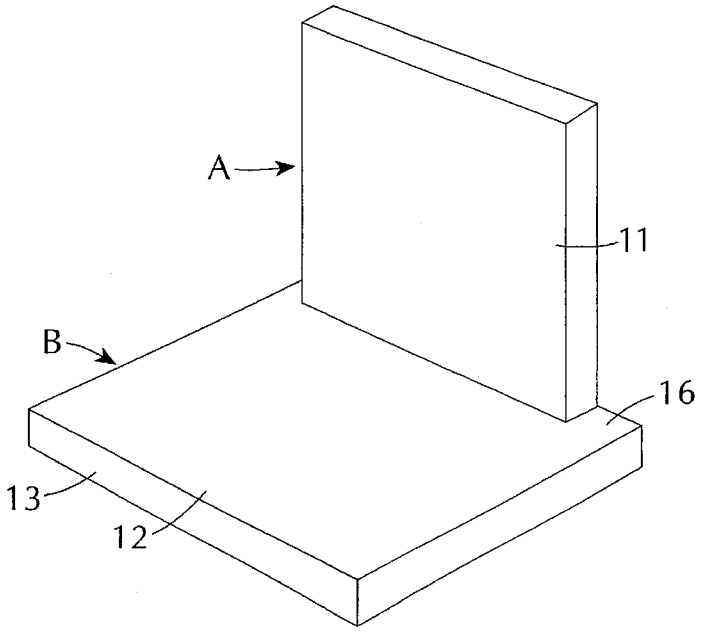
FIG. 6 is a perspective view of a display according to FIG. 1.

A basic embodiment of the point of purchase display of the invention is shown in drawing FIGS. 1, 2 and 4–8. In the perspective view of FIG. 6, the display is shown to comprise a vertically disposed riser generally designated by the reference character A and a horizontal base generally designated by the reference character B, as the display would generally appear when viewed from above by an observer in front of the display and at the display's right. The view of FIG. 6 shows that both the riser A and the base B present a box-like appearance, the riser A having a flat, front face 11 and the base B having an upper surface 12. The front face 11 of the riser A ordinarily bears a photograph or other pictorial display and/or advertising or promotional text (not illustrated in the drawings) and is therefore ordinarily flat and smooth, but there could be one or more apertures through the surface 11 if desired. The upper surface 12 of the base is also illustrated as flat for simplicity of illustration, but it should be understood that one, or usually several depressions or indentations can be formed in the upper surface 12 of the base to hold articles such as items displayed for sale. For example, a plurality of cylindrical wells could be formed in the upper surface 12 of the base to receive and hold small articles such as packaged cosmetics, and the base 12 could have a profiled upper surface, with one or more areas raised vertically above others in the form of steps or platforms, which could themselves be formed with article-receiving indentations or depressions. The base B is preferably made by vacuum forming or injection molding of a thermoplastic material such as styrene, and such techniques of shaping articles from thermoplastics permit the articles so formed to have any of a wide variety of configurations, as is well understood in the art. The flat surface 12 as shown in the drawings has accordingly been chosen for purposes of illustration only so as not to suggest any particular conformation of the upper surface of the base B.

Figure 8:
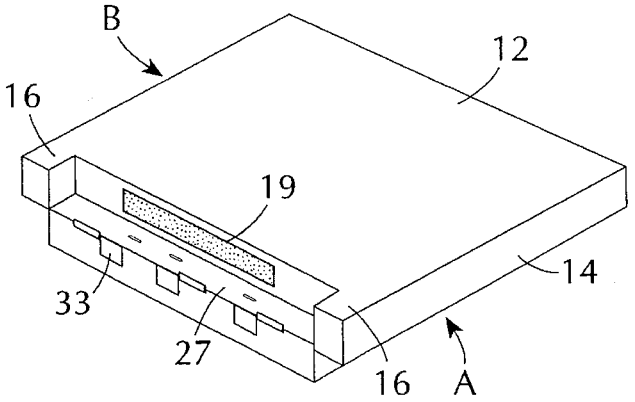
FIG. 8 is a perspective view of the display of FIG. 7 with the riser folded under the base.

It will be seen that when the display of the invention is in the shipping or storage state, as illustrated in FIGS. 5 and 8, the riser A is rotated through an angle of 270 degrees to lie flat against the base B. In that compact condition, the surface 12 of the base B faces outward, as does the surface 11 of the riser A, so it is not necessary that either of the surfaces 11 or 12 be flat.

FIG. 1 also shows the riser A as smaller in overall dimensions than the base B, but the relative dimensions of these parts can be different from those illustrated. By way of non-limiting example, the riser A need not be generally square in plan as shown in FIG. 2, but can be shaped as a rectangle that is taller than it is wide as in FIG. 5 to show a tall rectangular picture on the face 11, without requiring any other changes in the riser structure.

The riser is preferably made of stiff cardboard, for example from 50 point cardboard stock, die cut to form the blank shown in FIG. 2, and generally designated by reference numeral 20. The main or body portion 11 of the blank 20 provides the face of the riser A, and a rectangular arm extends from each of the four sides of the rectangular body 11. Thus arms 21 extend from opposite sides of the base, and top and bottom arms 22 and 23 extend from the top and bottom respectively of the blank body 11. Score lines 28 define the outline of the blank body 11, and score lines 29, parallel to the scores 28, extend lengthwise along the arms 21–23, for erection of the blank 20 into the generally box-like form shown in FIGS. 1 and 4–8.

Figure 7:
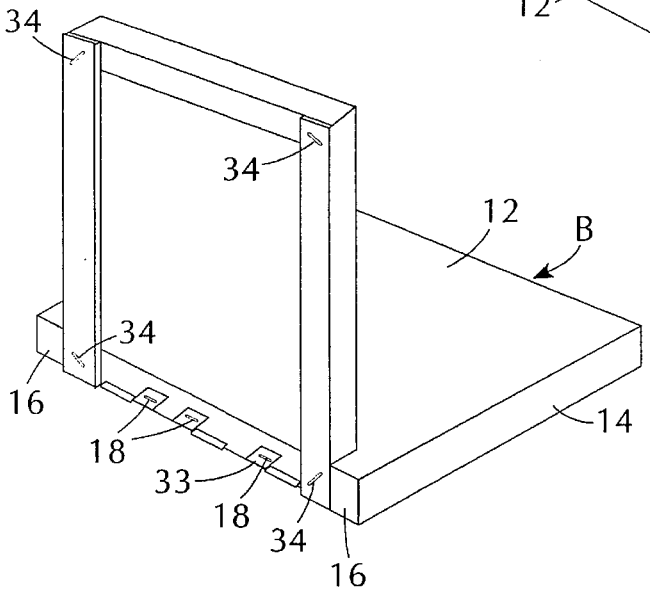
FIG. 7 is a perspective view corresponding to the view of FIG. 1 but with the riser and base secured together and the riser standing upright.

The arms 21–23 are folded through an angle of 90 degrees with respect to the base along the score lines 28. Elongated rectangular flaps 25 and 26 of the top and bottom arms 22 and 23 respectively are folded through an angle of 90 degrees along the score lines 29 so that the flaps 25 and 26 lie in spaced parallel relationship to the body 11 of the blank 20, and the elongated rectangular flaps 24 of the side arms 21 are folded through an angle of 90 degrees along the score lines 29 to overlie the flaps 25 and 26 and accordingly also to lie in spaced parallel relationship to the body 11 of the blank 20 as best shown in FIGS. 1, 4 and 7. To accommodate this overlapping relationship of the flaps, the score lines 29 of the side arms 21 are preferably spaced slightly farther away (say 1/16 inch) from the score lines 28 than are the score lines 29 of the top and bottom arms 22 and 23. The overlapped flaps are stitched together at the four corners of the riser A by staples 34, as shown in FIG. 1, but it should be understood that some other form of attachment, such as a tongue and groove joint, could be employed to join the flaps together at the corners.

The foregoing simplified description of the erection of the riser A has not referred to the fact that the bottom arm 23 is not an intact single piece like the top arm 22 and the side arms 21 when the riser A is erected. A central elongated rectangular portion 27 of the bottom arm flap 26 is separated from the end portions **26*a* of the flap 26 by cutting through the material of the flap 26 along lines 30. The cuts along line 30 extend from the outer edge of the flap 26 to the score line 29, perpendicular to the score line 29 as shown in FIG. 2. The central portion 27 of the flap 26 is accordingly left free when the end portions 26*a* of the flap 26 are stapled to the flaps 24 as seen in FIG. 1. This central portion 27 of the flap 26** will serve as a part of the hinge connection between the riser A and base B in the assembled display.

As shown in FIG. 2, the bottom flap 23 also has several, preferably three, die cut, spaced rectangular holes 33 that extend inward from the score line 29 toward the body of the blank 20, and two slits 32 are formed through the flap 23 along the score line 29. These slits 32 can suitably be located alongside the holes 33. The central flap portion 27 is thus left connected to the inner part of the arm 23 only at those areas along the crease scores 31 which have not been severed in cutting out the holes 33 and slits 32. The crease scores at 31 differ from the other score lines 28 and 29 previously described, the other score lines 28 and 29 being cut scores, which permit folding motion in one direction only. The cut scores 28 and 29 made by scoring the finished side of the cardboard, allow bending away from the opening made by the cut. In the case of a riser A narrower than the riser illustrated, the number of holes 33, crease scores 31 and slits 32 can be reduced. For example, there could be two holes 33, one crease score 31 and one slit 32.

Figure 3:
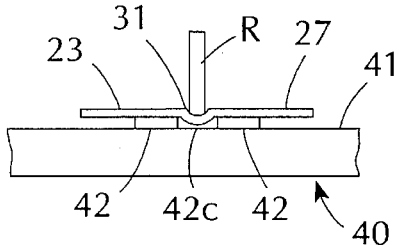
FIG. 3 schematically illustrates the formation of a crease score.

The formation of a crease score 31 is schematically illustrated in FIG. 3, in which 40 represents a die cutting press with the usual plate 41. A piece of cardboard 42, preferably of a thickness similar to that of the cardboard in which a crease score is to be formed, is placed on the plate surface where it may be held in place by double-sided tape (not shown), and a channel **42*c* is formed by cutting out a section of the cardboard 42 at the location where the crease score 31 is to be formed in a sheet of cardboard (here the arm 23) placed on top of the cardboard 42. A crease rule R is then pressed down toward the plate 41 pushing the cardboard material forming the arm 23 into the interior of the channel 42*c* and producing the crease score 31. Normally, a crease score like the crease score 31 is folded only in the direction of the score, in this case, toward the back side of the blank 20. This is because there is a certain amount of spring tension produced by the fibers constituting the cardboard. The bending of the flap 27 of the arm 23 in both directions along line 29 of the arm 23 is facilitated by the slits 32 cut along the line 29 and extending between the locations of the crease scores 31 and the holes 33. The spring tension of the material at the crease scores 31 does not significantly impede folding in both directions as the riser A moves forward and back with respect to the base B between the positions shown in FIGS. 7 and 8**.

The base B of the display of FIGS. 1, 2 and 4–8 is formed in one piece by vacuum forming or injection molding of a thermoplastic material such as styrene, and can accordingly have any color chosen to complement the product to be displayed and the pictorial illustration on the riser A. The upper surface 12 of the base B and its function and some possible surface features for displaying products have been discussed. The base B is shown (for example, in FIGS. 6–8) as generally box-like in overall shape, with one upright front wall 13, upright side walls 14 and a vertical rear wall 15 extending down from the upper surface 12. The base front wall 13 and side walls 14 are shown as vertical elongated rectangular downward extensions of the upper surface 12, but these walls 13 and 14 could if desired, form an angle of greater than 90 degrees with the upper surface 12, in which case the walls 13 and 14 would be trapezoidal in outline. The base B is open from below for ease of formation, but could have a bottom piece attached, if desired.

At its rear, the base B in the embodiment of FIGS. 1, 2 and 4–8 has two spaced rearwardly extending legs 16 at opposite ends of the base rear wall 15 and a horizontal base flange 17 extends between the lower ends of the legs 16, the base rear wall 15, legs 16 and flange 17 defining a rectangular step at the rear of the base between the upper base surface 12 and the flange 17 within which step the lower portion of the riser A is received when the riser A is upright as shown in FIGS. 1, 4, 6 and 7.

The central portion 27 of the bottom arm flap 26 is secured to the base flange 17 by a plurality of staples 18 as shown in FIGS. 4, 5, 7 and 8. The riser A is held in its upright position by means of piece of conventional foam-backed tape 19, shown in FIGS. 1, 4 and 5 as a rectangular strip of tape adhesively secured to the base rear wall 15. The outer, or rear face of the tape 19 has a coating of adhesive which serves to releasably secure the lowermost part of the front face 11 of the riser A to the rear wall 15 of the base B when the riser A is in its upright position as shown in FIG. 4.

The display can be stored and shipped with the outer face of the tape 19 protected by a removable strip of sheet material such as a piece of waxed paper, which can be peeled off the foam tape 19 before setting the riser upright. The adhesive on the outer surface of the foam-backed tape 19 is preferably of a known type which will hold the riser A firmly in place.

The riser A of FIGS. 1, 2 and 4–8 is preferably assembled and then secured to the base B as follows. When the small rectangular pieces of cardboard are cut from the arm 23 to form the holes 33, the small rectangles are left in place. The small rectangles do not separate from the rest of the cardboard because the knife with which the cuts are made is nicked, that is, small nicks are made in the cutting edge of the knife by tapping the knife edge with a chisel at a few (say three) spaced positions. The cardboard is not severed at the nick locations when the knife cuts through the cardboard, leaving the small rectangles attached at those locations. The central portion 27 of the flap 26 is then folded back through an angle of 180 degrees on top of the inner portion of the bottom arm 23 and the bottom end of the riser A is placed over the flange 17 of the base B and adjusted so that the lower front of the face 11 of the riser A presses lightly against the outer face of the foam-backed tape 19, the adhesive surface of which is at this time covered by a protection strip of wax paper or the like. This adjusts the relative positions of the riser A and base B to a proper interfitting relationship. Staples 18 can then be driven through the three superposed layers constituted by the base flange 17, the central portion 27 of the flap 26 and the small rectangular cutouts. When the riser A is folded back away from the position in which the face 11 is pressed against the tape, the three small rectangular cutouts pop out of the arm 23, leaving the holes 33. These small rectangles assist in holding the staples 18 in place.

Although the structure of the riser A and the base B have been described in detail with particular reference to the embodiment of the display of the invention illustrated in FIGS. 1, 2 and 4–8, various modified versions of the display to be discussed and illustrated as well as other variations, can advantageously employ many of the same structural features. In the description of the embodiments illustrated in FIGS. 9–20, elements which are like those described in detail with respect to the foregoing FIGS. 1, 2 and 4–8 are designated by similar reference characters.

Figure 14:
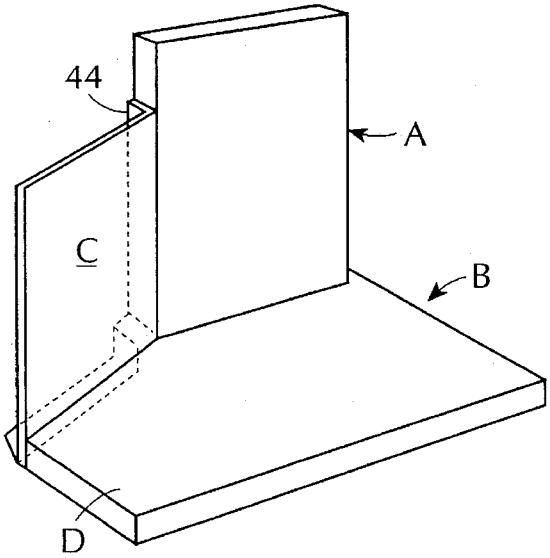
FIG. 14 is a view of the display of FIG. 9 from a different angle, with dashed lines showing hidden parts.

Thus, in the embodiments of FIGS. 9, 10 and 14 the riser A is generally similar to the riser of the embodiment previously described, with top and bottom arms 22, 23, score lines 28, 29, bottom flap central portion 27, cutout holes 33 and crease scores 31 as described, and the base has a rearwardly extending flange 17 and legs 16. The embodiment of FIGS. 9 and 10 has, however, a wing generally designated by reference character C that extends from the riser A, and the base D of this embodiment differs from the base B in that the base D has an extension to underlie the wing C.

The riser A and the wing C are formed from the blank generally designated by reference numeral 50 in FIG. 10, which differs from the blank 20 of FIG. 2 in that one side arm is integrally formed with a rectangular extension panel 52. A line defined by front score lines 29*a* and a back score line 43 extends parallel to the score line 28 of the arm 21 of the blank 50 of FIG. 10, and a further front score line 45 lies in spaced parallel relationship to the back score line 43. Slits are cut through the cardboard at 46, 47, 48 and 49 as shown in FIG. 10. A rectangular panel 44 is defined by the back score line 43, the front score line 45 and the slits 46 and 48, allowing the wing C to be swung outward as shown in FIG. 9. The panel 44 is seen to be folded back along the score line 43 when the display is in upright position as indicated in FIG. 9, wherein the panel 44 is seen to be held in its folded back position by staples 51.

The extension D of the base shown in FIG. 9 is formed as an integral part of the base B, with a vertical rear wall 55, and can have a rearwardly extending flange 57. A strip 59 of foam-backed tape like the tape strip 19 of the embodiment of FIG. 1, can hold the wing C in position.

Figure 11:
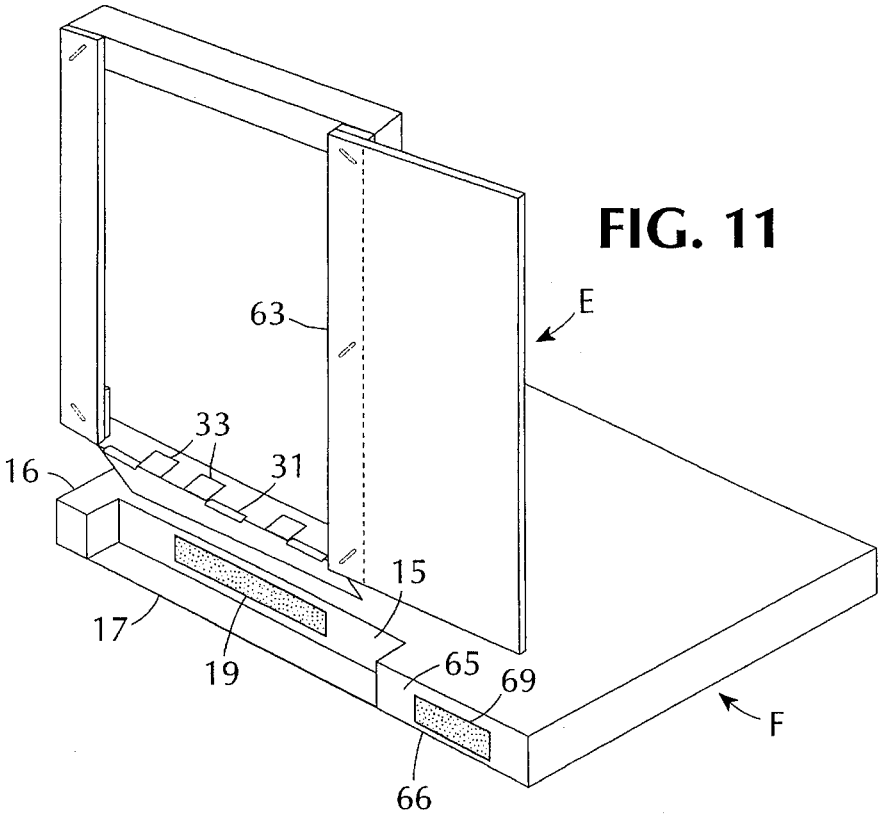
FIG. 11 is a perspective view similar to the views of FIGS. 7 and 9 showing another modified form of the display of the invention.
Figure 12:
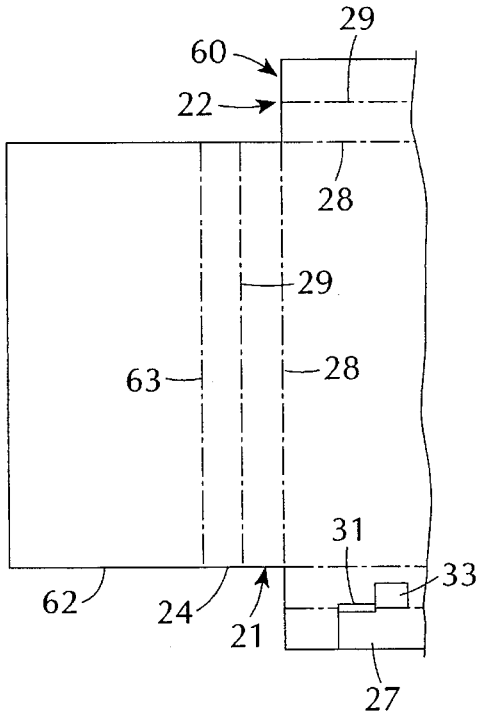
FIG. 12 is a partial plan view of the blank from which the riser of the display of FIG. 11 is formed.
Figure 13:
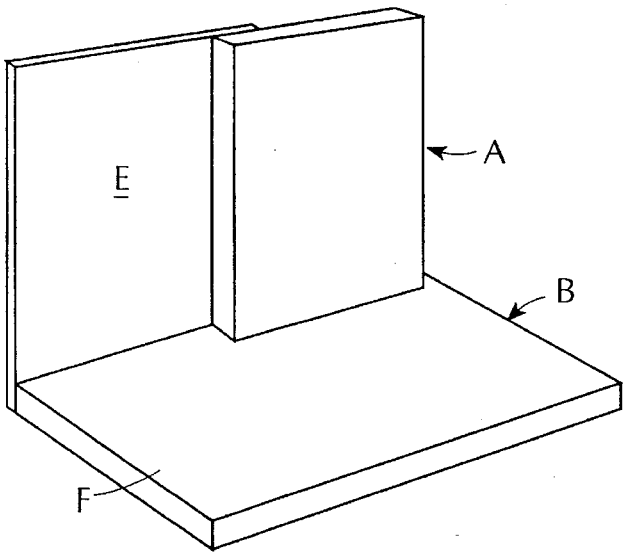
FIG. 13 is a view of the display of FIG. 11 from a different angle.

The embodiment of the display illustrated in FIGS. 11–13 is similar to that of FIGS. 9 and 10 in that a wing E extends from the riser A, and an extension F of the base B underlies the wing E. The blank 60 of FIG. 12 is similar to the blank 50 of FIG. 10, except that no slits are cut through the arm 21 and flap 24 of the blank 60. Score line 29 is a continuous front score from top to bottom of the arm 21 and back score line 63 also extends parallel to line 29 across the entire flap 24, allowing the wing E to be folded so as to extend from the rear of the frame-like structure of the riser A as seen in FIG. 11. The leg 66 of the base is wider than the leg 16, with a vertical rear face 65 against which the wing E can be held in place by a strip of foam tape 69.

Figure 15:
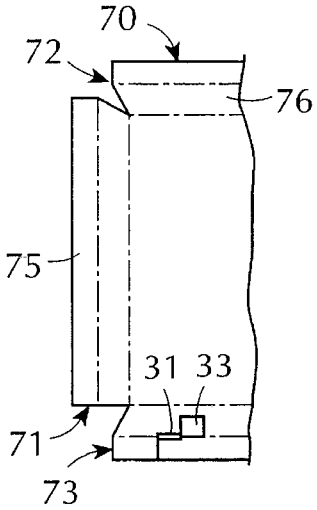
FIG. 15 is a plan view of a blank for forming a riser with beveled side panels.
Figure 16:
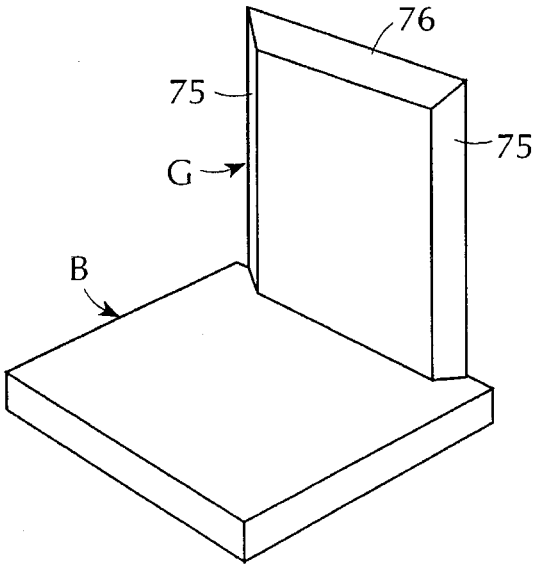
FIG. 16 is a view in perspective of another modified form of the display of the invention.

The blank 70 of FIG. 15 is similar to the blank 20 of FIG. 2 except that the arms 71 and 72 have their ends cut at a slant rather than at the right angles of the arms 21–23 of FIG. 2, forming trapezoidal side and top panels 75 and 76, so that the riser generally designated G in FIG. 16 which is formed from the blank 70 presents a different appearance from that of the riser A.

FIGS. 17–20 show embodiments of a display according to the invention which has a riser and a base interconnected for hinging movement so that the riser can be folded under the base for convenient storage and shipping, but in which the hinging mechanism is simpler than that of the embodiment of FIGS. 1–8.

Like the displays already discussed, the displays of FIGS. 17–20 have a riser that can be cut from a flat sheet of cardboard, and which has fold lines lying parallel to side and bottom edges, but fewer folds are employed in the risers of the displays of FIGS. 17–20, which are accordingly simpler and even less expensive to manufacture than those previously described.

The riser generally designated by reference character H in FIGS. 17, 18 and 20, has a generally rectangular body 81, the front surface of which serves as the upright face of the display when the riser H is in its upright position as shown in FIG. 20. In the particular example illustrated, the upper part 82 of the body 81 has been shown as die cut to present an oval outline. It will be understood that the structure of this display allows great freedom of design and that the oval shape is shown only as an example of one of the possible options. At the sides of the body 81, front score lines 83 lie parallel to the side edges of the body 81. Slide flaps 84 fold back along the score lines 83 as seen in FIGS. 17 and 20.

A front score 85 and a back score 86 extend along lines parallel to each other and parallel to a bottom edge 87 of the base 81, defining an elongated rectangular flap 87 that runs along the bottom of the riser and a panel 88 shown as similar in size and shape to the flap 87.

As seen in FIGS. 17 and 18, when the riser H is attached to a base B, which is illustrated as identical with the base shown in FIG. 1, the flap 87 is secured to the rear flange 17 of the base B by staples 18, one of which is shown in FIG. 18, although preferably several staples 18 are employed to hold the parts of the display together securely. A strip of foam-backed tape 19 serves to attach the body 81 of the riser H to the vertical surface 15 of the base B holding the riser H upright.

The side flaps 84 are simply folded back along the score lines 83 and held in place by the inner vertical surfaces of the legs 16 of the base B.

The embodiment of FIG. 19 differs from that of FIGS. 17, 18 and 20 in that a wing I extends from the front score 93 at one side of the riser body J in the embodiment of FIG. 19. The base K has an extension L to underlie the wing I, as in the embodiment of FIG. 9, the extension of the base D underlies the wing C. Also, as in the embodiment of FIG. 9, the extension L has a vertical rear wall 55 to which the back of the extension I is attached by means of the tape strip 59.

The score lines 95 and 96 of the embodiment of FIG. 19 correspond structurally and functionally to the score lines 85 and 95 of the embodiment of FIG. 17.

The displays of all of the embodiments of the invention are easy to set up at the place where they will be used, and are inexpensive and easy to fabricate.

Numerous variations, modifications and adaptations of the display of the invention will suggest themselves to those acquainted with the art, without departing from the spirit and scope of the invention.

What is claimed is:

1. A three-dimensional point of purchase display having a generally horizontal base and a riser mounted on the base for pivoting movement with respect to the base from a compact shipping configuration in which the riser underlies the base to a display configuration in which the riser stands upright and extends vertically from a rear side of the base, wherein: the base is integrally formed as a downwardly open box with a top surface for supporting a displayed product and front, rear and side walls extending downward from edges of the top surface, said rear wall terminating in a flat horizontal flange; the riser comprising a generally rectangular body having a front face for displaying information, a straight score line extending parallel to a straight bottom edge of said body defining a generally rectangular bottom arm bent back at an angle of ninety degrees with respect to said front face, and a flap at an outer end of the arm foldable in either direction along a weakened line parallel to said front score line, means securing said flap to the flange whereby the riser is pivotable about the weakened line from a position underlying the base to an upright position; and means on the rear wall of the base for holding the riser in upright position.

2. The three-dimensional display of claim 1 wherein the riser has front score lines extending parallel to straight side edges of said body and defining generally rectangular side arms bent back at an angle of ninety degrees with respect to said front face, each of said side arms having a second front score line parallel to the score lines defining the side arms, and a front score line extending parallel to a top edge of said body defining a generally rectangular top arm bent back at an angle of ninety degrees with respect to said front face, said top arm having a second front score line parallel to the score line defining the top arm, top and side flaps bent along said second front score lines so that the top and side flaps lie parallel to the base, and means securing the top flap to the side flaps.

3. The three-dimensional display of claim 2 and including means securing the side flaps to the bottom arm.

4. The display of claim 1 wherein the base has a rearwardly extending upright wall at each end of the flange, the riser being received between said upright walls when the riser is the display configuration.

5. The three-dimensional display of claim 1 wherein the weakened line includes at least one slit cut through the bottom arm.

6. The three-dimensional display of claim 1 wherein at least one hole is cut through the bottom arm adjacent the weakened line.

7. The three-dimensional display of claim 1 wherein the means for holding the riser in upright position comprises an adhesive means on the rear wall of the base.

8. The three-dimensional display of claim 7 wherein the adhesive means comprises a strip of adhesive tape.

9. The three-dimensional display of claim 1 wherein the base is formed of thermoplastic material.

10. The three-dimensional display of claim 1 and including a side wing extending from one side of the riser body, said wing being pivotally movable with respect to the face of the riser body along a score line.

11. A three-dimensional point of purchase display comprising a base with a flat rear flange and a riser having a generally flat body and a bottom flap formed by a first score line extending parallel to a lower edge of the body, said flap being secured to said flange for pivotal motion of the riser with respect to the base from a shipping condition wherein the riser underlies the base and a condition wherein the riser stands upright at an angle of ninety degrees with respect to the base, a second score line parallel to first score line defining a rectangular strip inward of the flap which strip is foldable along said second score line through an angle of one hundred and eighty degrees to overlie the flap when the riser is upright.

12. The three-dimensional display of claim 11 wherein the base has an upstanding rear wall and including means for securing the riser to the rear wall to hold the riser upright.

13. The three-dimensional display of claim 12 wherein the means for securing the riser to the rear wall is an adhesive means on the rear wall.

14. The three-dimensional display of claim 13 wherein the adhesive means is a strip of adhesive tape.

15. The three-dimensional display of claim 11 wherein the riser has side flaps folded back at an angle of ninety degrees with respect to the body and the base has spaced legs at opposite ends of the flange so that when the riser is upright the side flaps lie against inner upright faces of the legs.

16. The three-dimensional display of claim 11 and including a side wing extending from one side of the riser body.

17. A three-dimensional display including a base which is integrally formed as a downwardly open box with a top surface and front, rear and side walls extending downward from edges of the top surface, and a riser wherein the base has a flat rear flange and the riser has a bottom flap extending parallel to one edge of the riser, the flap being secured to the flange for pivotal motion from a first position having the riser under the base to a second position having the riser stand upright with respect to the base and means on one of the rear wall and the riser for holding the riser upright.

18. The three-dimensional display of claim 2 wherein the means for holding the riser upright is on the bases.

* * * * *

UNITED STATES PATENT AND TRADEMARK OFFICE

CERTIFICATE OF CORRECTION

PATENT NO. : 5,581,923

DATED : December 10, 1996

INVENTOR(S) : EDWARD BRANDSTETTER

It is certified that error appears in the above-identified patent and that said Letters Patent is hereby corrected as shown below:

Column 10, line 56 (Claim 18, line 1), change "2" to --17--.

Column 10, line 57 (Claim 18, line 2), change "bases" to --base--.

Signed and Sealed this

Fifteenth Day of July, 1997

Bruce Lehman

*Attest:*

BRUCE LEHMAN

*Attesting Officer*

*Commissioner of Patents and Trademarks*